United States Patent [19]

Yonekura

[11] 4,022,429

[45] May 10, 1977

[54] LIFTING APPARATUS

[75] Inventor: Sukio Yonekura, Higashimurayama, Japan

[73] Assignee: Daido Kiko Co., Ltd., Tokyo, Japan

[22] Filed: Dec. 19, 1975

[21] Appl. No.: 642,466

[30] Foreign Application Priority Data

Mar. 13, 1975 Japan ..... 50-30355
Mar. 18, 1975 Japan ..... 50-36352

[52] U.S. Cl. ..... 254/95; 74/422; 74/460

[51] Int. Cl.[2] ..... B66F 3/02

[58] Field of Search ..... 254/95, 97, 86 R, 103; 74/422, 460

[56] References Cited

UNITED STATES PATENTS

| | | | |
|---|---|---|---|
| 2,986,954 | 6/1961 | Werner | 74/422 |
| 3,288,435 | 11/1966 | Starkey | 254/86 R |
| 3,351,321 | 11/1967 | Grams et al. | 254/86 R |
| 3,543,598 | 12/1970 | Langenberger | 254/103 |
| 3,770,070 | 11/1973 | Smith | 254/86 R |

FOREIGN PATENTS OR APPLICATIONS

| | | | |
|---|---|---|---|
| 787,765 | 12/1957 | United Kingdom | 74/422 |

*Primary Examiner*—Al Lawrence Smith
*Assistant Examiner*—Robert C. Watson
*Attorney, Agent, or Firm*—Oblon, Fisher, Spivak, McClelland & Maier

[57] ABSTRACT

A lifting apparatus wherein a cone rack mechanism having cone pieces interlocked to driving gears is driven by such driving gears, which are connected and controlled by a special friction clutch mechanism, a latch mechanism, and a centrifugal brake, for continuing the lifting and lowering of a body, such as a water gate.

6 Claims, 9 Drawing Figures

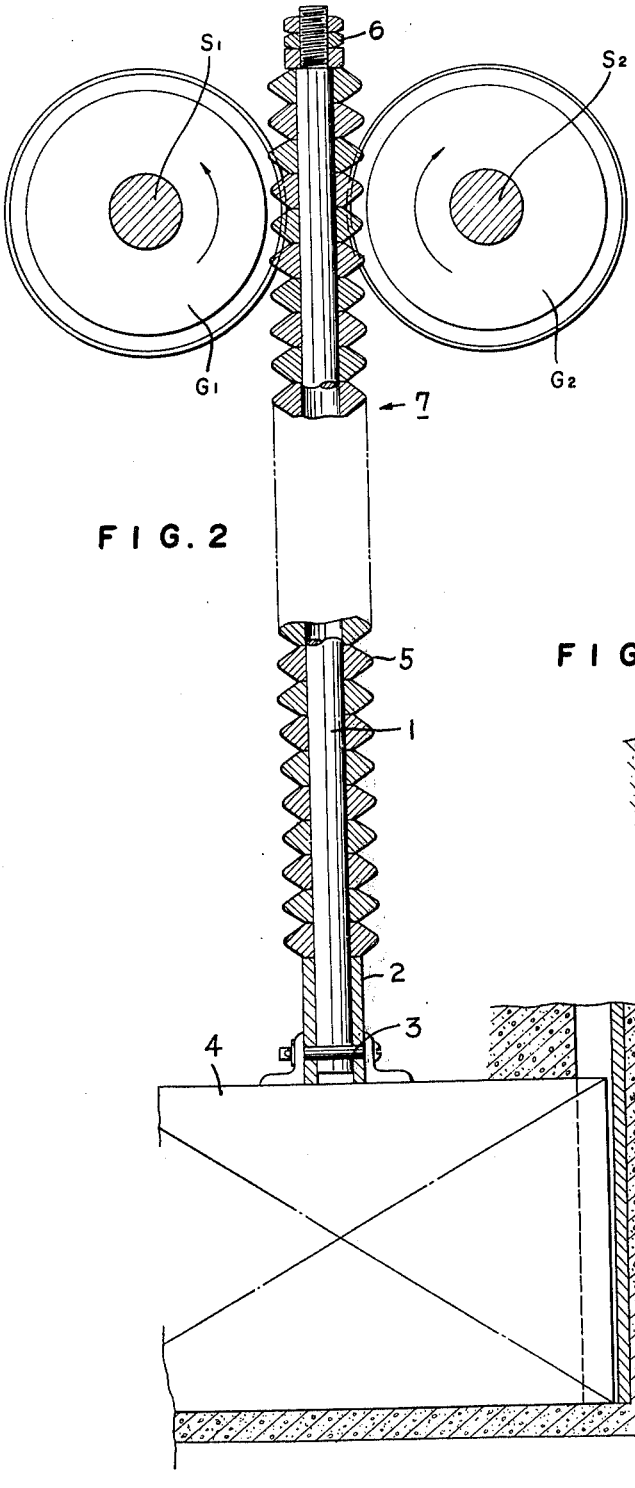
FIG. 2
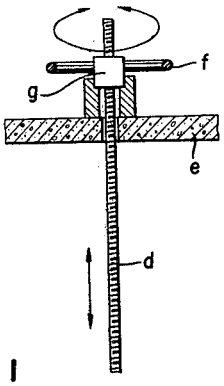
FIG. 1
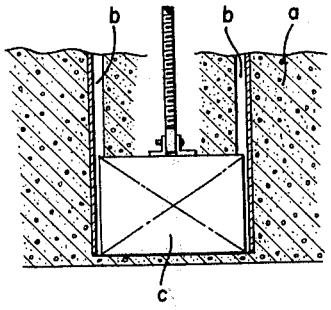

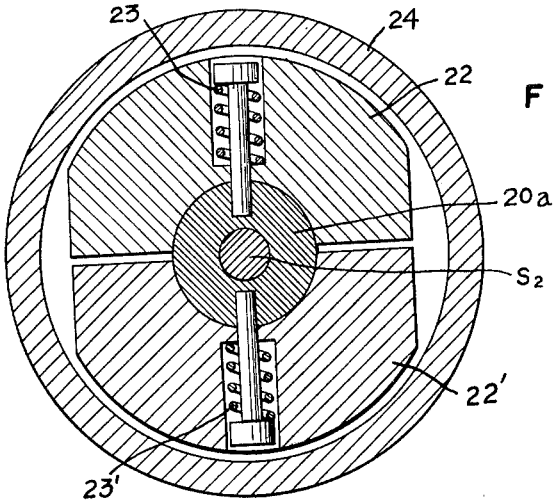
FIG. 6
FIG. 7
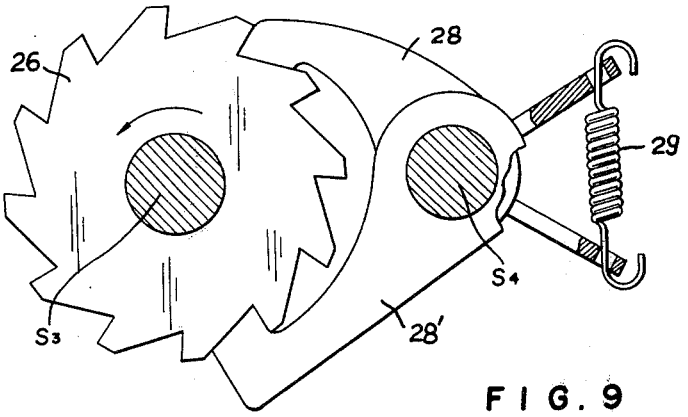
FIG. 8
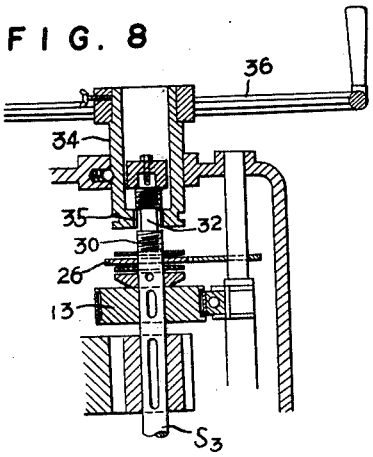
FIG. 9
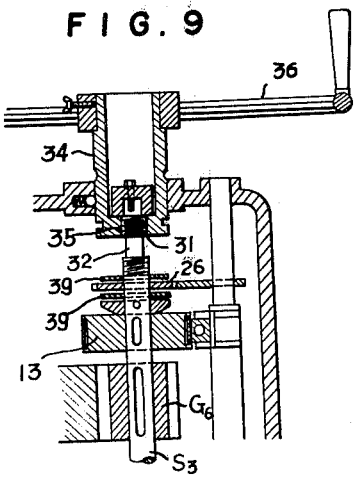

LIFTING APPARATUS

BACKGROUND OF THE INVENTION

The present invention relates generally to a lifting apparatus and more particularly to such an apparatus for raising water gates and the like.

In conventional lifting apparatus used for water gates, a structure similar to that shown in FIG. 1 is employed, wherein a water gate body (c) vertically slidably disposed in a guide rail frame (b) is disposed at the outlet of water on a weir (a) and a bottom of a threaded lift stem (d) is fixed to the top of the gate body (c). The lift stem (d) is screwed on a nut (g) of an operation handle (f) disposed on a base table (e). Obviously, a reduction gear can be connected between the lift stem (d) and the operation handle (f), if desired. The water gate body (c) can be raised, held in a suspended state and lowered through operation of the screw-threaded lift stem attached thereto.

The lifting apparatus described has a simple structure an is low in cost and can stop the gate body at a desirable position without a special stopping device. Accordingly, such conventional water gate lifting apparatus have been effectively used until now with high evaluation.

However, the conventional lifting apparatus disadvantageously requires a long operation time for raising and lowering the gate body, even though it does possess such advantages as described herein. Manual operation is difficult and with the conventional lifting apparatus it is disadvantageously difficult to quickly and safely lower the gate body in times when danger of flood exists.

It has therefore been proposed to provide a lifting apparatus for a water gate body which comprises a pin rack stem connected at the top of a gate body, suitable gears for causing ascending and descending motion of the pin rack and a driving mechanism for driving these gears. Production of water gates is not significant in number and the length of a pin rack is different, depending upon the height of the gate body, according to each of the locations of the water gates. Accordingly, water gates are produced only upon receipt of orders thereof, and the productivity thereof is quite low. That is, the term for production after receipt of an order is relatively long to thus cause high cost to become a factor.

Since a lifting apparatus for a water gate body may cause a serious accident through troubles encountered in the operation thereof, it is necessary that they be produced to provide accurate and safe operation.

SUMMARY OF THE INVENTION

It is therefore an object of the present invention to provide a lifting apparatus which provides accurate and safe operation and operates for raising, stopping and lowering a gate body by an easy operation and at a desirable speed.

It is another object of the present invention to provide a lifting apparatus which is easily adjusted during construction to result in low cost.

It is yet another object of the present invention to provide a lifting apparatus for rapidly closing a water gate body in complete safety.

The foregoing and other objects of the present invention have been attained by providing a lifting apparatus which comprises a cone rack mechanism having cone pieces interlocked to driving gears and which is driven by those driving gears, which in turn are connected to and controlled by a special friction clutch mechanism, a latch mechanism and a centrifugal brake.

BRIEF DESCRIPTION OF THE DRAWINGS

Other objects, features and attendant advantages of the present invention will be more fully appreciated as the same becomes better understood from the following detailed description when considered in connection with the accompanying drawings, wherein like reference characters designate like or corresponding parts, and in which:

FIG. 1 is a schematic view of a structure of a conventional lifting apparatus of the type used for raising and lowering a water gate;

FIG. 2 is an enlarged schematic view of an embodiment of the lifting apparatus according to this invention;

FIG. 6 is an enlarged vertical sectional view of an embodiment of the centrifugal brake according to present invention;

FIG. 7 is an enlarged side view of the latch mechanism; and

FIGS. 8 and 9 are respectively partial vertical views of the lifting apparatus for illustrating different operational states thereof.

DETAILED DESCRIPTION OF THE PREFERRED EMBODIMENT

Figure 3:
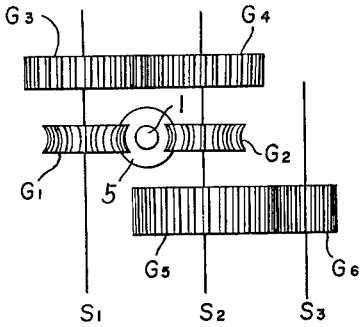
FIG. 3 is a schematic view showing a gearing mechanism of the lifting apparatus according to the present invention.

Referring now to the drawings and more particularly to FIG. 2 thereof, one embodiment of the invention is illustrated wherein a cone rack mechanism generally designated by the reference character 7 comprises a lift stem having a cone stem 1 made of a solid bar, having a desirable length, the bottom end of which is pivoted with a pin 3 through a stop collar 2 to a water gate body 4. A desirable number of cone pieces 5 are fitted on the cone stem 1, as beads on an abacus, above the stop collar 2 and nuts 6 are screwed on the stem at the top of the cone pieces so as to fix the series of cone pieces. This lift stem is driven by a set of gears $G_1$ and $G_2$ by interlocking to the cone pieces on both sides of the lift stem.

The gears $G_1$ and $G_2$ are mounted on respective driving shafts $S_1$, $S_2$, which respectively carry gears, $G_3$ and $G_4$, which are interlocked with each other, as shown in FIG. 3. The gears $G_1$, $G_2$ are simultaneously driven through gears $G_5$, $G_4$ and $G_3$ by a gear $G_6$ mounted on another driving shaft $S_3$. Accordingly, the lift stem can quickly be raised and lowered by rotating the driving shaft $S_3$.

Figure 4:
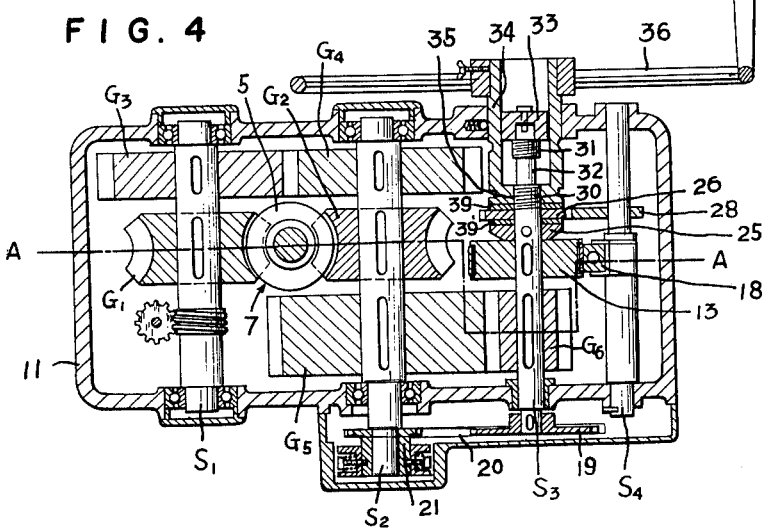
FIG. 4 is a horizontal sectional view of the embodiment of the lifting apparatus of the invention illustrated in FIGS. 2 and 3.
Figure 5:
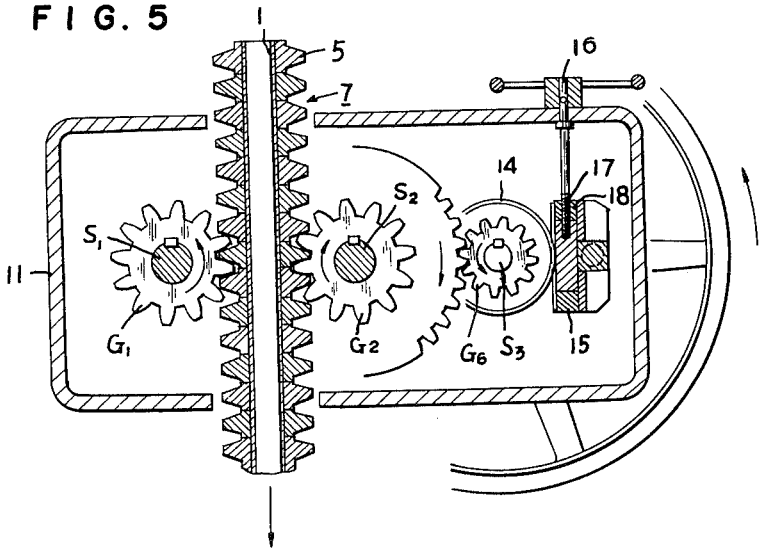
FIG. 5 is a sectional view taken along the line A—A of FIG. 4, with partial omissions for the sake of clarity.

In the lifting apparatus of the present invention, a mechanism for controlling a safe and accurate movement is shown in FIGS. 4 and 5, wherein the reference numeral 11 designates a casing separable into two parts, as an upper part and a bottom part. The reference characters $S_1$ and $S_2$ designate driving shafts rotatably mounted in parallel relation in the casing 11 and $S_4$ designates a fixed shaft. The driving shafts $S_1$ and $S_2$ respectively carry the gears $G_1$ and $G_2$, having the same number of teeth and the same dimensions, which are respectively interlocked to the cone pieces 5 of the cone rack mechanism 7 and the driving shafts respectively carry the gears $G_3$ and $G_4$, which are meshingly engaged with each other. The rotating shaft $S_2$ also has gear $G_5$ mounted thereon which is driven through the gear $G_6$ by driving shaft $S_3$.

A brake drum 13 of a band brake means is fixed on the driving shaft $S_3$. One end of a brake band 14 is connected to a fixed block 15 mounted on the fixed shaft $S_4$ while the other end of the brake band is connected to a movable block 18 which can be shifted by screw rod 17 provided with a brake handle 16. The reference numeral 19 designates a large radial chain sprocket wheel and 21 designates a small radial chain sprocket wheel. A chain 20 is interconnected between the sprocket wheels 19 and 21 and accordingly, when the driving shaft $S_3$ is rotated, the sprocket wheel 21 is rotated at a high speed whereby slide pieces 22 and 22' mounted on a boss 20*a* are radially pushed out under the centrifugal force against the forces of springs 23 and 23' and the slide pieces are pressed onto the inner surface of the cylindrical body 24, as seen in FIG. 6, depending upon the rotating speed, so as to impart a damping force to the driving shaft $S_3$.

A friction disk connecter 25 is mounted on the driving shaft $S_3$, and a ratchet wheel 26 for preventing reverse revolution during a winding operation is rotatably mounted on the driving shaft $S_3$, as shown in FIG. 7.

The reference numerals 28 and 28' designate ratchet pawls connected to the fixed shaft $S_4$ which are normally interconnected to the ratchet wheel 26 by means of a tension spring 29, which connects the other ends of the ratchet pawls 28, 28'.

The reference numeral 30 designates a right-hand externally threaded portion for providing ascending movement and 31 designates a right-hand externally threaded portion for providing descending movement, respectively, of the gate, between which a nonthreaded portion 32 is formed on the driving shaft $S_3$. A stop collar 33 is mounted on the outer end of the screw portion 31 for providing descending movement. An operation handle sleeve 34 comprises an internally threaded portion 35 having a length smaller than that of the nonthreaded portion 32 which can be threadably engaged to the threaded portions 30 and 31.

Friction disks 39 and 39', composed of, for example, asbestos plates, are disposed on the shaft $S_3$ on opposite sides of the ratchet wheel 26. When the water gate body 4 is to be raised up, the brake handle 16 is reversely rotated to release the brake band 14, thereby maintaining the band brake means in the non-operational state. Then the operation handle 36 is rotated in the clockwise direction to engage the threaded portion 35 of the handle sleeve 34 with the threaded portion 30 for providing ascending movement formed on the driving shaft $S_3$, as shown in FIG. 4. Accordingly, the end surface of the operation handle sleeve 34 pushes the friction disk 39, the ratchet wheel 26 and the friction disk 39' toward the friction disk connector 25 so as to joint to the driving shaft $S_3$. The driving shaft $S_3$, which is prevented from reverse revolution by means of the ratchet pawls 28, 28', is clockwisely rotated to ascend the cone rack mechanism 7, which is interlocked through the gears $G_3$, $G_4$, $G_5$ and $G_6$ to the gears $G_1$ and $G_2$. Accordingly, the water gate body can be lifted up.

When the water gate body 4 is to be lowered, the brake handle 16 is reversely rotated and the movable block 18 is upwardly shifted as shown in FIG. 5, to actuate the band brake. In this case, as the latch mechanism is also effective, a double locking effect can be performed. The operation handle sleeve 34 is reversely or counter-clockwisely rotated to release the threaded portion 35 from the threaded portion 30 for providing ascent so that the threaded portion 35 is shifted into the region of the non-threaded portion 32, to be free, as shown in FIG. 8.

Accordingly, the friction disks 39, 39' and the ratchet wheel 26, which are pushed on the friction disk stopper 25, will be free of each other so as to be rotatble around the driving shaft $S_3$. Accordingly, it becomes the condition that the water gate body 4 is supported only by the brake band 14. When the tension of the brake band 14 is released by turning the handle 16 in the counter-clockwise direction, the water gate body 4 begins to descend under the dead weight thereof and its descent speed will gradually increase.

The slide pieces 22, 22' of the centrifugal brake are shifted against the force of the springs 23, 23' in a radial direction, depending upon the increase of the descent speed, to contact with the inner surface of the fixed drum brake 24, whereby the damping force corresponding to the descent speed is actuated to the driving shaft $S_3$ and, accordingly, the water gate body can be safely and quickly lowered.

In such type of lifting apparatus for a water gate, it is necessary to forcibly push down the water gate body to the bottom in order to attain waterproofing at the bottom edge of the water gate body. This purpose can be attained by the following operation of the lifting apparatus of the present invention.

The handle 36 is pulled up and then turned in a counter-clockwise direction. The internally threaded portion 35 of the cylindrical sleeve 34 is moved so as to engage the threaded portion 31 for providing descent under full contact, as shown in FIG. 9. The waterproof condition of the water gate body can thus be maintained by turning the handle 16 to tighten the brake band 14.

As stated above, the cone rack mechanism of the lifting apparatus of the present invention can be prepared as follows. Many cone pieces 5 are produced in advance and a desirable number of the cone pieces are fitted on the cone stem, which can be a hollow or a solid rod, so as to form a series of cone pieces. Both ends of the stem on which the series of the cone pieces are fitted are anchored. Accordingly, a desirable length of the cone rack mechanism can be quickly and easily arranged, as desired, and the production cost is highly economical when compared with that of the conventional pin rack mechanism.

While the lifting apparatus of the present invention can be readily used for various lifting operations, it is preferably used for lifting a heavy load, such as a water gate body. The lifting apparatus can easily and safely provide for ascent and descent of a water gate body in spite of variation in the water pressure against the gate body and it can advantageously shut the water gate in flooding periods in a short operation time.

Obviously, many modifications and variations of the present invention are possible in light of the above teachings. It is to therefore be understood that within the scope of the appended claims, the invention may be practiced otherwise than as specifically described herein.

What is claimed as new and desired to be secured by Letters Patent of the United States is:

1. A lifting appartus which comprises:

a cone rack mechanism having a cone stem means and a series of cone pieces fitted on said cone stem means;

first and second driving shafts disposed in parallel relation with one another in a casing, each driving shaft having a driving gear interlocked to the cone pieces of the cone rack mechanism; and an operating handle, axially slidable on a third driving shaft operatively connected to said first and second driving shafts and including first and second threaded shaft portion means, and a non-threaded portion interposed between said threaded portions, for alternatively engaging said threaded portion means so as to operatively drive said driving shafts in alternate directions whereby said shafts will similarly rotate said gears so as to alternatively move said cone stem means in opposite directions as desired for the performance of a driven ascending or descending operation of said lifting apparatus, and for engaging said non-threaded portion so as to drivingly disengage said third driving shaft from said first and second driving shafts whereby said cone stem means and said lifting apparatus descend under its own weight.

2. A lifting apparatus according to claim 1, wherein each of said cone pieces has a central hole for receiving said cone stem and an upper surface for contacting with a lower surface of an adjacent upper cone piece, a lower surface for contacting with an upper surface of an adjacent lower cone piece, and upper and lower slant surfaces, so as to be interlocked by said driving gear.

3. A lifting apparatus according to claim 1, which comprises a pair of gears interlocked to said cone rack mechanism in symmetrical positions relative thereto.

4. A lifting apparatus according to claim 1, which comprises means for preventing reverse rotation of said third driving shaft, said means comprising friction disks and a latch mechanism which can be disconnectably disposed on the third driving shaft.

5. A lifting apparatus according to claim 1, which comprises a centrifugal brake connected between the third driving shaft and at least one of the driving shafts having a gear interlocked to the cone rack mechanism.

6. A lifting apparatus for operating a rack stem having connected at its bottom end a water gate body which is lifted and lowered by movement of a driving gear interlocked to the rack stem, which comprises:

a centrifugal brake connected through a speed promoting device to a driving shaft carrying said driving gear;

a friction disk stopper fixed on said driving shaft;

a ratchet wheel rotatably mounted on said driving shaft and being connectable to said friction disk stopper at its side surface;

a pawl member for preventing reverse rotation, fixed to the casing and interlocked to the ratchet wheel;

said driving shaft having a threaded portion means for facilitating ascending motion of said lifting apparatus, a threaded portion means for facilitating descent of said apparatus and having an identical turn with said threaded portion for providing ascent and a non-threaded portion disposed between said identically threaded portions; and an operating handle having a threaded portion which can be engaged with the identically threaded portions and the length of which is smaller than that of the non-threaded portion.

* * * * *